United States Patent [19]

Boichot-Castagne et al.

[11] 4,401,872

[45] Aug. 30, 1983

[54] OPERATING MECHANISM OF A LOW VOLTAGE ELECTRIC CIRCUIT BREAKER

[75] Inventors: Bernard Boichot-Castagne, Sassenage; Roger Case, Seyssinet-Pariset; Reynald Marin-Pache, Claix, all of France

[73] Assignee: Merlin Gerin, Grenoble, France

[21] Appl. No.: 377,030

[22] Filed: May 11, 1982

[30] Foreign Application Priority Data

May 18, 1981 [FR] France ..... 81 10000

[51] Int. Cl.[3] ..... H01H 3/54

[52] U.S. Cl. ..... 200/153 G; 200/322; 335/26

[58] Field of Search ..... 200/153 G, 332, DIG. 42, 200/321, 322; 335/8, 9, 10, 26, 27

[56] References Cited

U.S. PATENT DOCUMENTS

| | | | |
|---|---|---|---|
| 2,795,670 | 6/1957 | Cellerini et al. | 335/8 |
| 3,134,879 | 5/1964 | Gauthier et al. | 200/322 X |
| 3,426,301 | 2/1969 | Bodge | 335/8 |
| 3,460,075 | 8/1969 | Yorgin et al. | 335/9 |
| 3,525,959 | 8/1970 | Ellsworth et al. | 200/DIG. 42 |
| 3,603,755 | 9/1971 | Ranzanigo | 200/153 G |
| 4,129,762 | 12/1978 | Bruchet | 200/153 G |
| 4,165,453 | 8/1979 | Hennemann | 200/153 G |
| 4,278,958 | 7/1981 | Kandatsu | 335/16 |

*Primary Examiner*—Stephen Marcus
*Assistant Examiner*—Ernest G. Cosick
*Attorney, Agent, or Firm*—Parkhurst & Oliff

[57] ABSTRACT

A multi-pole circuit breaker having a molded case and a contact operating mechanism supported in said case. The mechanism is controlled by a handle and a trip device. To obtain the reset of the trip hook when said trip device has opened the contacts, a rocker secured to the handle engages a drive lever forming an extension of the upper link of a toggle joint of said mechanism. The catch of the trip device is biased into an intermediate balanced locking position by means of a spring and is positioned onto a pivot pin by means of radial projection insides the bore of the catch which fits into a matching groove of the pin.

5 Claims, 13 Drawing Figures

TRIPPING

RESET-OPEN

CONTACTS WELDED

CLOSED

Fig 8
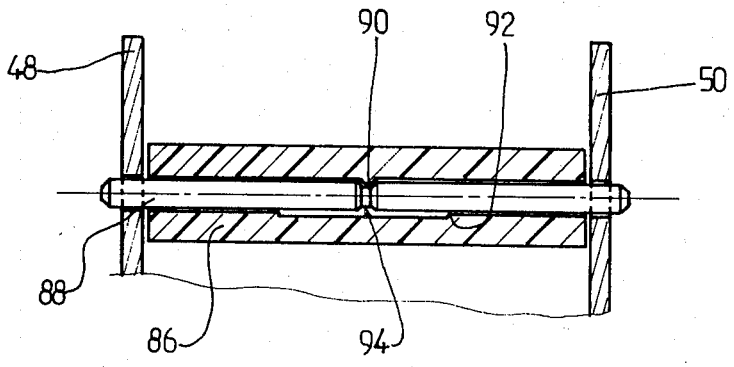
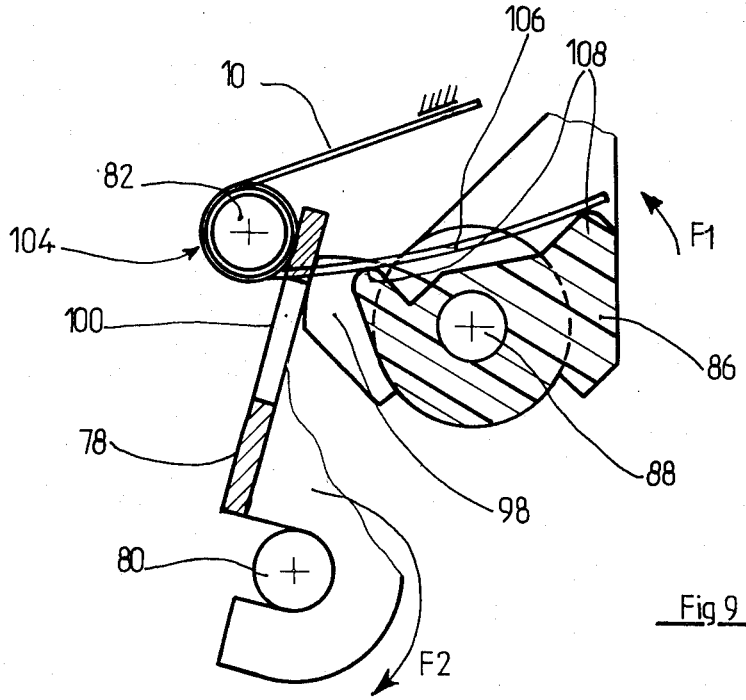
Fig 9

OPERATING MECHANISM OF A LOW VOLTAGE ELECTRIC CIRCUIT BREAKER

This invention relates to a multi-pole molded case circuit breaker having an operating mechanism actuated by a control handle and a trip device. Following a tripping operation the mechanism is reset by moving the handle to the extreme open or reset position.

In prior art operating mechanisms of the kind mentioned, the rocker, supporting the handle, drives the trip hook directly during the resetting phase, and this involves considerable sliding travel that generates friction forces between the two mechanical components. In order to avoid premature wear of the mechanism, the rocker and the trip hook must undergo appropriate surface treatments that increase the cost price of the assembly.

The object of this invention is to provide an operating mechanism involving reduced friction that requires no additional surface treatment.

According to the present invention, the upper link of the toggle joint is extended by a drive lever cooperating with the rocker to obtain the resetting of the trip hook in its reset position by operation of the handle. The resetting of the mechanism by means of the upper link in the toggle joint entails a short sliding travel of the drive lever on the rocker, and the friction generated is negligible.

The upper link is designed in a V-shape and comprises a first lever extending between the pivot pin of the toggle joint and the hinge pin of the trip hook, and a second drive lever that cooperates with the rocker.

Another object of this invention is to provide a circuit breaker so constructed that an operator cannot move the handle into the open position if the contacts are welded.

The rocker has a shoulder designed to thrust against a lug provided on the drive lever in order to stop the rocker supported handle in a position S and thereby block any attempt to open the circuit breaker manually if the contacts are welded. The afore-said lug is automatically withdrawn away from the shoulder when the toggle joint folds in and the contacts open normally. The lug on the drive lever has a dual function: it serves to drive the trip hook towards the reset position and to block the rocker when the contacts are welded.

The release device for the latch comprises an eccentric catch swivel-mounted on a pin. A radial projection insides the bore of the catch fits into a matching groove on the pin to fixedly secure the pin. A torsion spring positions the eccentric catch in relation to the latch and prevents any accidental triggering.

According to another feature of the invention, the bar connected to the lower link of the toggle joint is able to rotate on intermediate coaxial bushings supported on partition walls of the housing.

In a development of the invention, each contact arm is pressed against a bearing surface of the bar by a compression spring, and the contact arm position is adjusted by means of a spacer of predetermined thickness inserted in a slot in the bar in order to modify the angular position.

Other advantages and features of the invention will be more clearly understood from the following description of one embodiment of the invention, given as a non-exhaustive example, and illustrated in the attached drawings, in which:

FIG. 8 is a cross-section along line VIII—VIII in FIG. 2;

FIG. 9 is a part view of FIG. 2, showing the latch in position locked by the eccentric catch;

Figure 1:
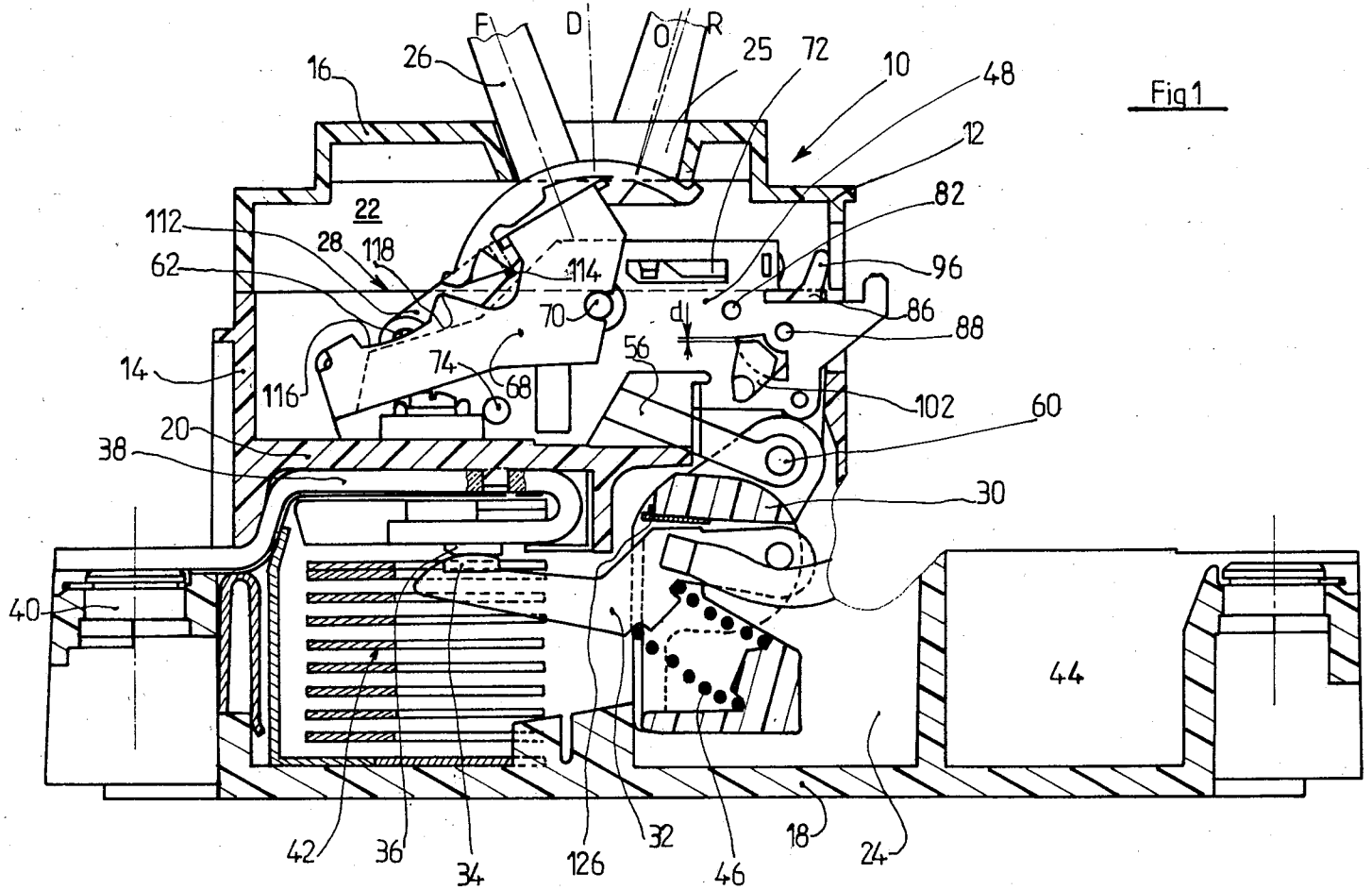
FIG. 1 is a cross-section through a breaker unit of a multi-pole circuit breaker shown in the closed position and equipped with an operating mechanism according to the invention.

On FIG. 1, a breaker unit 10 of a low voltage multipole circuit breaker is housed in a box 12 of molded insulating material made up of the assembly of an intermediate casing 14 with open ends, a lid 16 for the top and a base-plate 18 for the bottom. Casing 14 has a middle partition 20 parallel to the ends that divides the inner space of box 12 into an upper compartment 22 and a lower compartment 24 the two compartments being isolated from each other. Lid 16, casing 14 and baseplate 18 are assembled together by assembly accessories (not shown). Lid 16 has an opening 25 to accommodate a control lever or handle 26 for operating mechanism 28 housed in upper compartment 22. The poles are identical in design and are arranged side by side across the lower compartment 24 in planes parallel to that illustrated in FIG. 1. Operating mechanism 28 is associated with the center pole and transmits the movement to the adjacent poles via a common transverse bar 30 in insulating material.

Each pole has an arm 32 with a moving contact 34 cooperating in the closed position with a stationary contact 36 connected electrically by means of a conductor 38 to a connection terminal 40 of breaker unit 10. Each pair of stationary 36 and moving 34 contacts is surrounded by an arc extinguishing device 42 with deionizing plates, arranged in lower compartment 24 between conductor 38 and baseplate 18.

Driving bar 30 is swivel-mounted in lower compartment 24 and lies perpendicular to the various contact arms 32, driving them simultaneously when operating mechanism 28 is actuated either manually via control lever 26 or automatically via an interchangeable magnetothermal tripping unit (not shown). This tripping unit is accommodated in a transverse housing 44 in box 12 and is connected electrically to the poles in breaker unit 10 by means of connecting screws (not shown). A compression spring 46 inserted between bar 30 and the contact arm 32 of each pole, ensures the appropriate contact pressure when the circuit breaker is in the closed position. Control lever 26 can take three fixed angular positions, namely one limit position, F, for closing, an intermediate position D, for tripping on a fault detected by the tripping unit, and the opposite limit position, O, for manual opening of the circuit breaker.

Operating mechanism 28 (FIGS. 1 to 3) is mounted between two stationary supporting plates 48, 50 and comprises a toggle joint 52 having a knee pin 54 on which are hinged two pairs of links 56, 58 symmetrical with the mid-plane of operating mechanism 28. The lower link 56 of each pair is mechanically connected to transverse bar 30 by means of a connecting crankpin 60. Each upper link 58 is a V-shaped assembly and is hinged by a rivet or pin 62 to a side-arm 63 of a trip hook 64 lying in the gap between plates 48, 50. Operating mechanism 28 has two draw-springs 66 anchored between pin 54 on toggle joint 52 and rocker 68 supporting operating lever 26. Rocker 68 is mounted to swivel between position O and F of lever 26 on a transverse pivot 70 projecting from plates 48, 50. Pivot 70 acts as a buffer for trip hook 64 when it reaches the tripped position (FIG. 1) corresponding to position D of lever 26.

Rocker 68 of lever 26 is provided with a resetting linkage 72 for the tripping unit (not shown) fitted with a plunger energy storage device. Trip hook 64 is mounted to swivel between the reset and tripped positions on stationary pin 74 fixed to each plate 48, 50. On the free end of hook 64 there is a hooking catch 76 to engage with latch 78 when hook 64 is pivoted towards the reset position. Latch 78 is swivel-mounted on stationary pin 80 supported by plates 48, 50 and a return spring 84 fitted on pin 80 brings latch 78 to bear against a buffer 82 formed by a rod parallel to pin 80.

Figure 3:
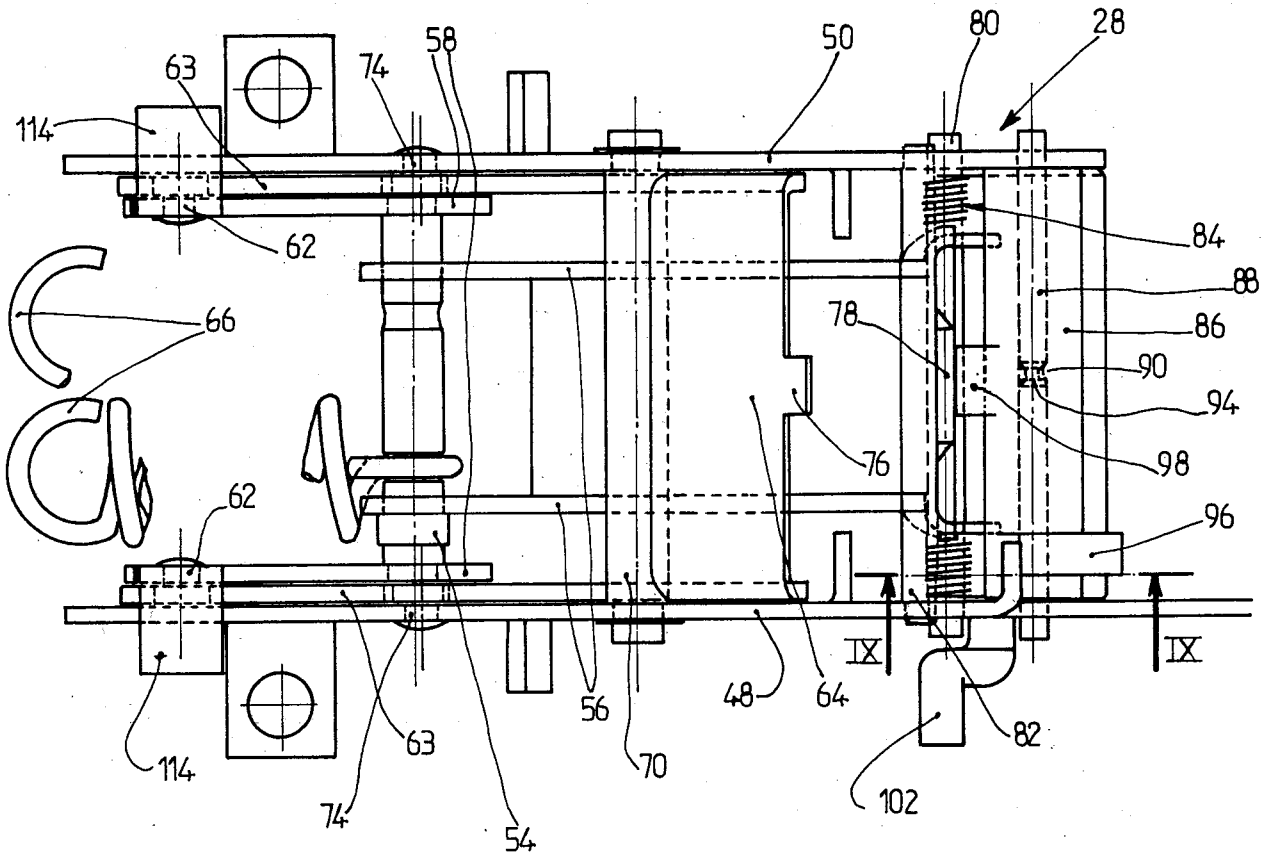
FIG. 3 is a plan view of FIG. 2, without the control handle.

A control component of latch 78 comprises an eccentric catch 86 in plastic, mounted between plates 48, 50 to rotate on pin 88 lying parallel to the transverse pin 80 of latch 78. Eccentric catch 86 is in equilibrium on its pin 88 and has a projection or central boss 90 provided inside bore 92 of eccentric catch 86 designed to fit into a matching groove 94 in pin 88 (FIGS. 3 and 8). This pin is positioned in the aligned holes in plates 48, 50 and held in position by eccentric catch 86. The unreleasable mounting of pin 88 eliminates any need for means, such as circlips, to block translation. Central boss 90 is obtained directly by molded.

Eccentric catch 86 has a releasing lug 96 cooperating with the plunger in the tripping unit to trigger mechanism 28 when a fault occurs. Tripping is entailed by the counter-clockwise pivoting of eccentric catch 86 shown by arrow $F_1$ (FIG. 2), and the engagement of latching catch 98 in the opening 100 of latch 78. Latch 78 is no longer locked by eccentric catch 86 and the torque exerted by trip hook 64 in the reset position causes latch 78 to tumble in the clockwise direction (arrow $F_2$) into the unlatched position. Hooking catch 76 is then freed from latch 78 and trip hook 64 automatically pivots round pin 74 to the tripped position due to the action of springs 66 in mechanism 28.

To avoid any accidental triggering of mechanism 28 possibly caused by impacts or vibrations due to the opening and closing operations of the circuit breaker, an elastic device is used to position eccentric catch 86 in relation to latch 78 so that a predetermined clearance d (FIG. 1) is provided between shoulder 102 of eccentric catch 86 and plate 48. This clearance d prevents any impact from being transmitted from plate 48 to eccentric catch 86. This positioning of eccentric catch 86 by an elastic device is achieved by means of torsion spring 104 one end 106 of which bears on two bosses 108 of eccentric catch 86 (FIG. 9). Spring 104 is fitted on rod 82 of latch 78 and the other end 109 of spring 104 bears on a bent lug of stationary plate 48. Torsion spring 104 has therefore a dual function in that it serves to draw back eccentric catch 86 into the locking position of latch 78 and as an elastic device to position eccentric catch 86 in relation to plate 48 and to latch 78.

Each V-shaped upper link 58 in toggle joint 52 comprises a first lever 110 between swivel pin 54 of the toggle joint and hinge pin 62 of trip hook 64. A second lever 112 extends from pin 62 to rocker 68 forming an acute angle with first lever 110. The free end of the second lever 112 is designed as a lug 114 bent at right angles and cooperating with rocker 68 so as to drive trip hook 64 into the reset position where hooking catch 76 engages with latch 78. This resetting operation of mechanism 28 takes place when control lever 26 moves in the clockwise direction from tripping position D, to resetting position R. The bent lug 114 of each link 58 lies crosswise and towards the outside of the gap provided between plates 48, 50 and between positions D and R of operating lever 26 bears on a slightly concave front sliding surface 116 of rocker 68.

Figure 6:
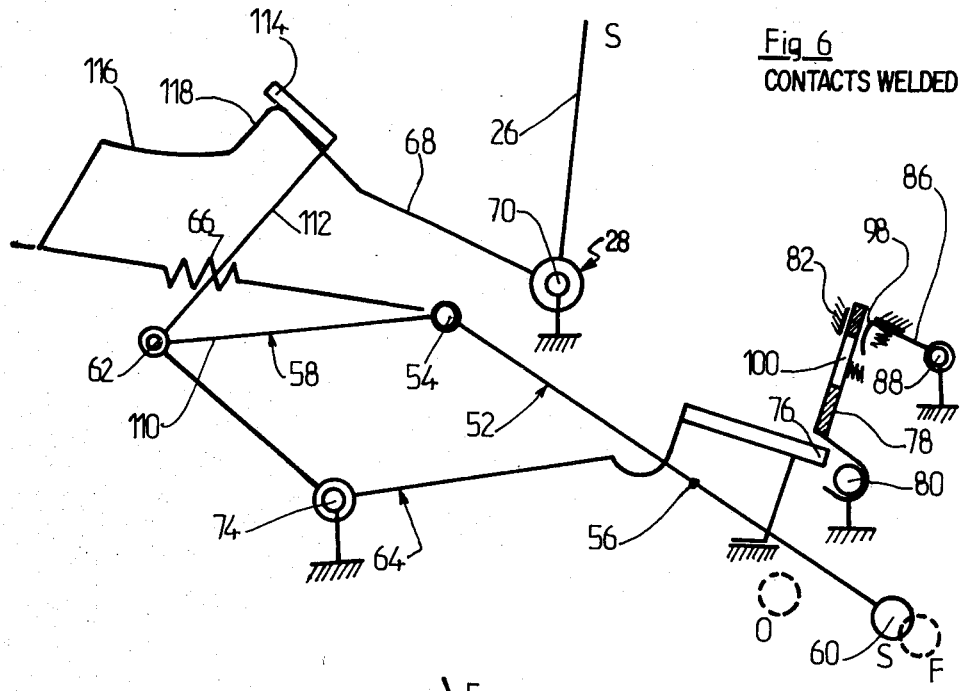
Figure 7:
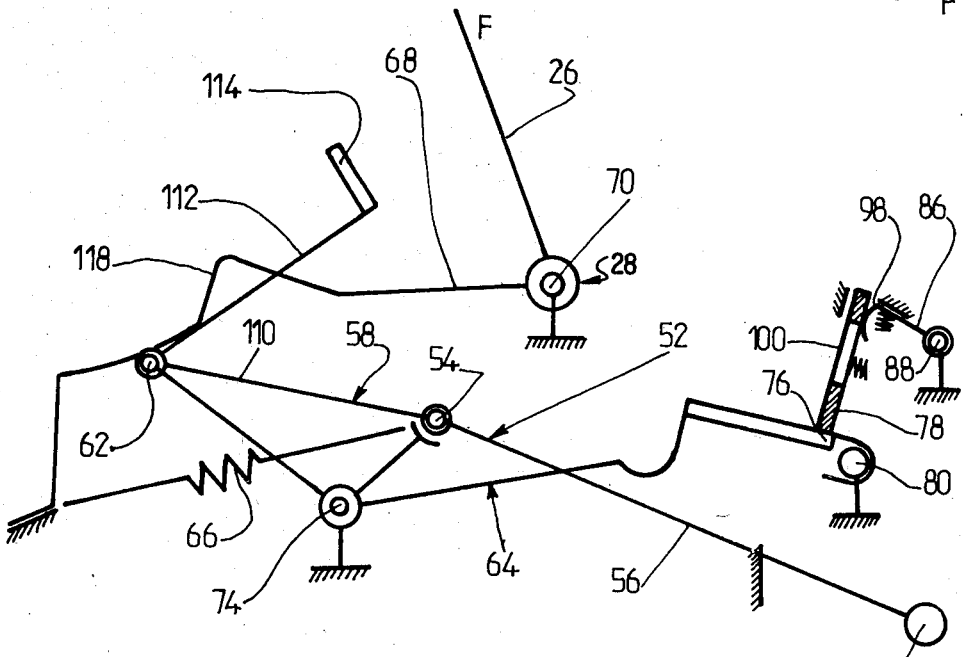

Rocker 68 also has a shoulder 118 provided between concave part 116 and control lever 26 designed to act as a buffer for lug 114 of each upper link 58 in order to stop operating lever 26 in position S and block any attempt to open the circuit breaker manually if the contacts have joined due to welding (FIG. 6). Under normal operating conditions of the circuit breaker, when the contacts are not joined, lug 114 does not get in the way of shoulder 118 on rocker 68.

Resetting of mechanism 28 via upper links 58 in toggle joint 52 involves a short sliding travel of each link 58 on the concave part 116 of rocker 68. The resulting friction is negligible compared with a classical resetting device by means of the trip hook 64, so that untreated parts can be used. Control lever 26 is automatically blocked in position S if the contacts are joined by the interaction of rocker 68 with upper links 58 of toggle joint 52.

Figure 10:
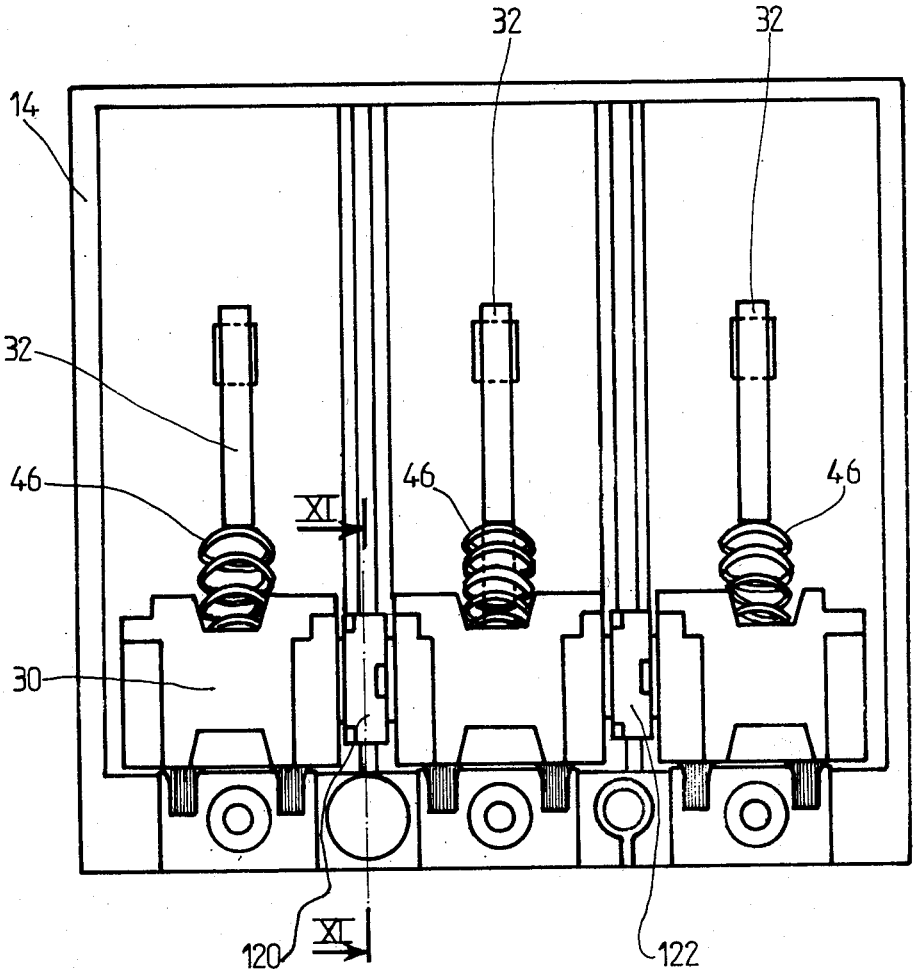
FIG. 10 is a view from below of the intermediate casing with the transverse bar mounted.
Figure 11:
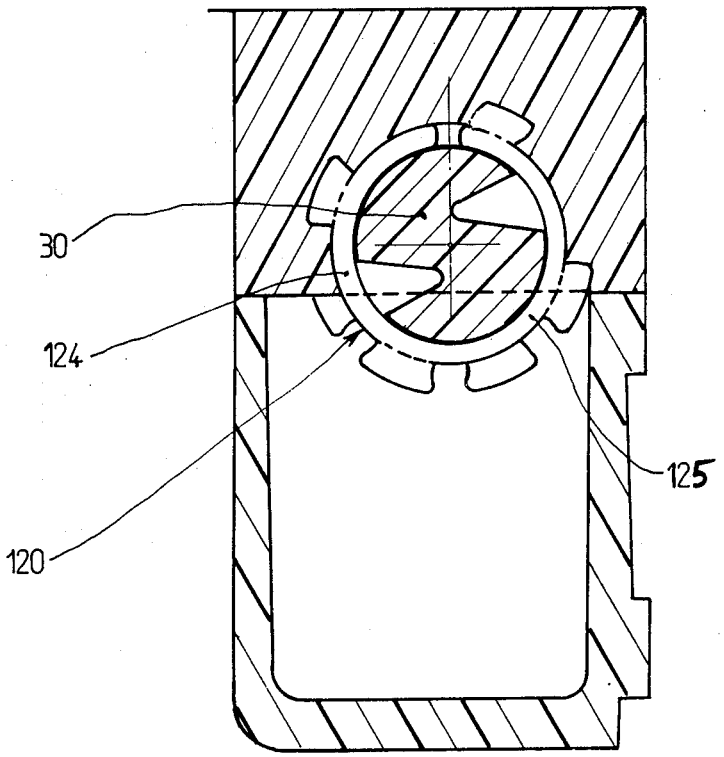
FIG. 11 is a cross-section along line XI—XI in FIG. 10.

On FIGS. 10 and 11, transverse bar 30 supporting moving contact arms 32 of the various poles is connected to lower links 56 of mechanism 28 and is positioned by two coaxial bushings 120, 122 or intermediate anti-wear bearings, with a transverse separation between the two formed by the width of the central pole. Plastic bushings 120, 122 rest on the boxes of casing 14 and baseplate 18 at the level of the internal partitions forming the pole compartments. The swivel mounting of bar 30 requires no special guide-pin or end bearings in the facing side walls of box 12. Each intermediate bushing 120, 122 is assembled around bar 30 by snap-fitting the free ends of a half-open ring with axial slit or of two matching half-rings 124, 125.

Figure 13:
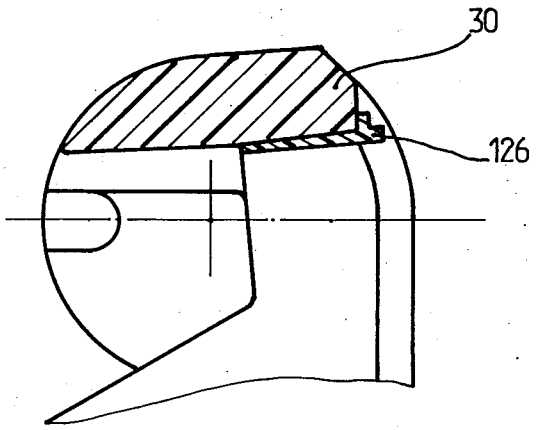
FIG. 13 is a cross-section along line XIII—XIII in FIG. 12.
Figure 12:
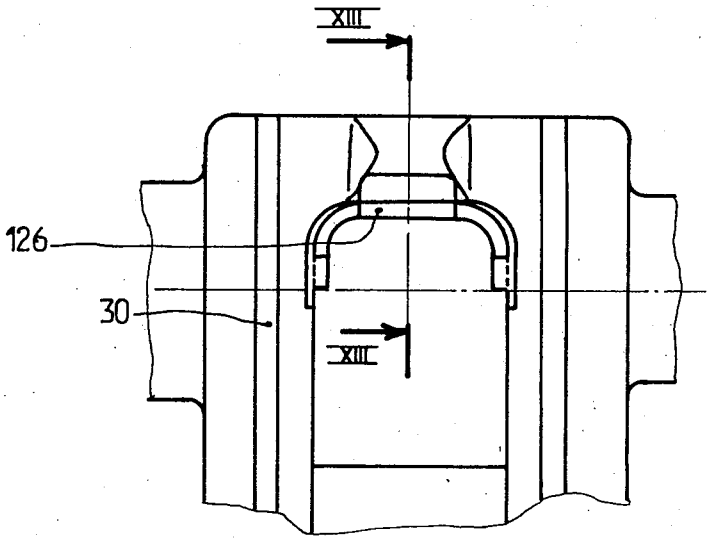
FIG. 12 is a part elevation view of the bar with the adjustment spacer inserted.

Moulding defects of the plastic parts and manufacturing tolerances of the elements in mechanism 28 influence the downward pressure exerted on the moving contact arms 32 of the various poles. This downward pressure at each pole is adjusted by means of spacer 126 (FIGS. 1, 12 and 13) which adjusts the relative position of moving contact 34 to corresponding stationary contact 36. Each spacer 126 is in plastic and is inserted in a slot in bar 30 in order to modify slightly the angular position of the bearing surface of contact arm 32. The position of each spacer 126 on bar 30 takes place after manual separation of contact arm 32 corresponding to the opposing force of compression spring 46. Adjusting spacers 126 of various thickness can be used to compensate manufacturing tolerances as exactly as possible.

Figure 2:
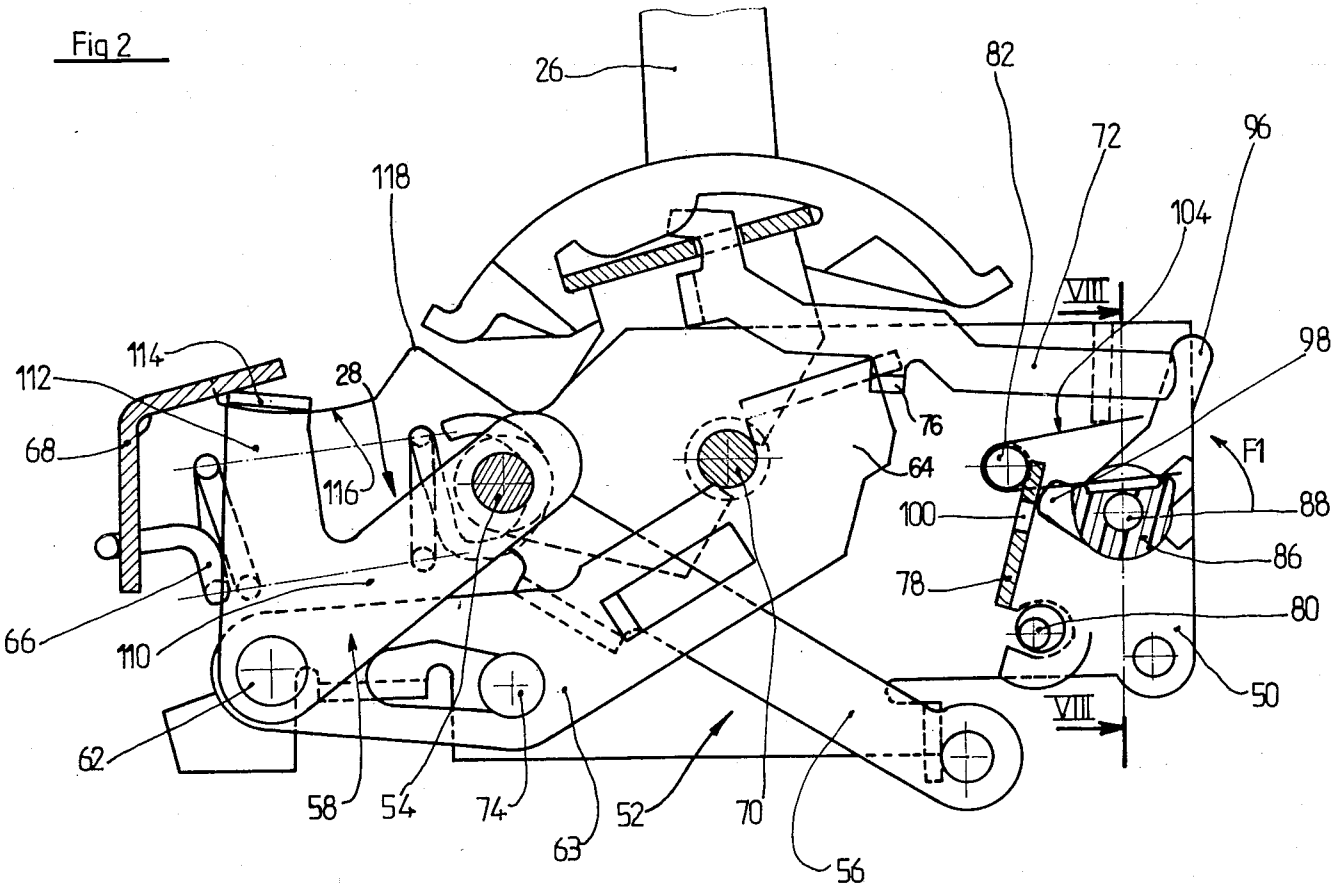
FIG. 2 is an elevation view of the operating mechanism shown in the fault-triggered tripping position D.
Figure 4:
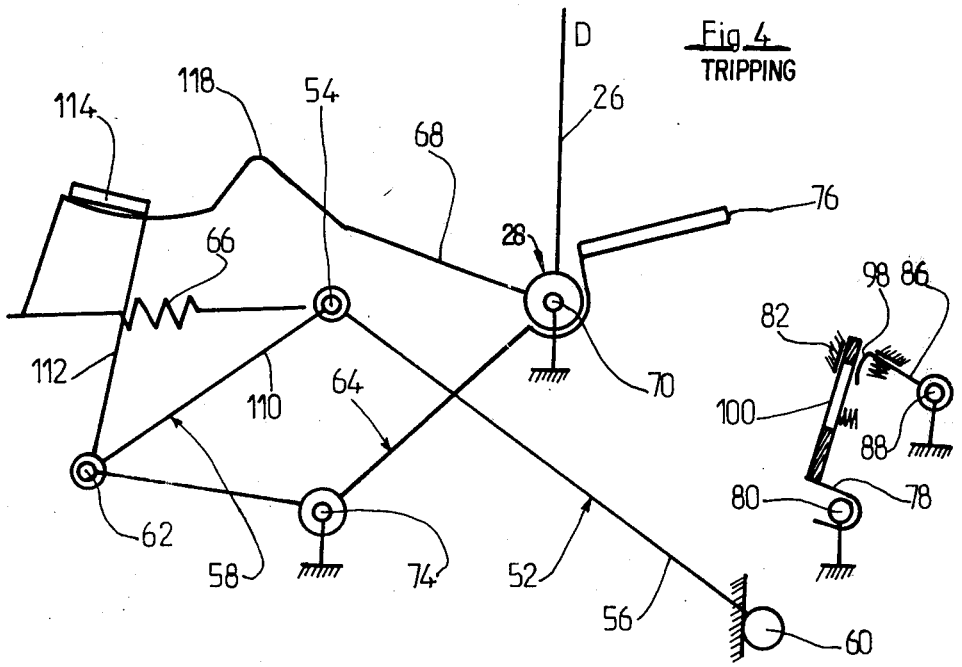
FIGS. 4 to 7 are schematic views of the mechanism in the respective positions: D, tripping, R, reset-open, S, handle blocked when the contacts are welded, and F, circuit breaker closed.
Figure 5:
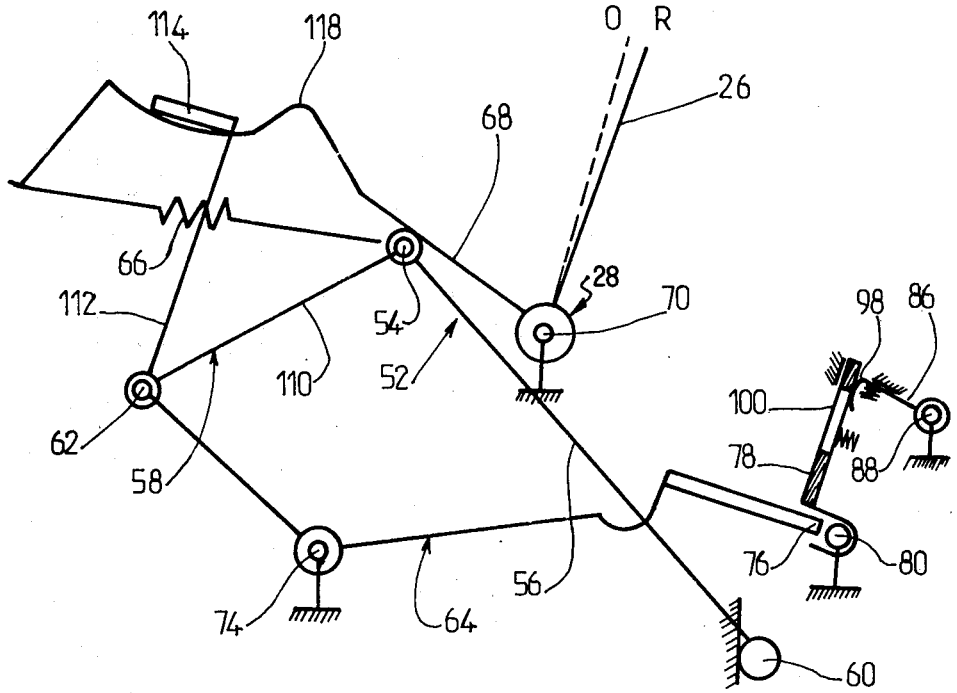

The operation of drive mechanism 28 according to the invention is schematically illustrated on FIGS. 4 to 7:

In the tripping position D, of the circuit breaker shown on FIGS. 2 and 4, trip hook 64 released from latch 78 has caused toggle joint 52 to fold in through the action of springs 66 and is thrust steadily against pivot 70 of bar 68. Lug 114 at right angles on drive lever 112 of each upper link 58 bears on sliding surface 116 of rocker 68.

Resetting of mechanism 28 takes place by manually moving control lever 26 clockwise from position D to a resetting position R close to position O. While rocker 68 swivels round pivot 70, the drive lever 112 of each upper link 58 in toggle joint 52 is pulled upwards by reaction of surface 166 of rocker 68 on right-angled lug 114. This lug travels over surface 116 in a sliding movement limited in extent which does not generate considerable opposing frictional force. This causes trip hook 64 to tumble clockwise about pin 74 into the reset position (FIG. 5), in which hooking catch 76 engages with latch 78 thrust against buffer 82. Eccentric catch 86 holds latch 78 in this position, and lug 114 on each link 58 continues to bear steadily on surface 116 of rocker 68. In position R of control lever 26, the secondary resetting linkage 72 fixed to rocker 68 actuates resetting of the energy storage device associated with the tripping unit.

After reseting of mechanism 28, the circuit breaker closes in a traditional manner by pivoting control lever 26 in the opposite direction to position F (FIG. 7), to bring pins 62, 54, 60 of toggle joint 52 into approximate alignment. The clockwise pivoting of lug 114 on upper links 58 does not interfere with the trajectory in the opposite direction of shoulder 118 of rocker 68 corresponding to the movement of control lever 26 into position F.

If the contacts are joined, manual opening of the circuit breaker by actuating control lever 26 from position F towards position O is stopped in intermediate position S (FIG. 6) due to the fact that shoulder 118 on rocker 68 thrusts against right-angled lug 114 on upper links 58. Trip hook 64 remains reset with hooking catch 76 engaged with latch 78.

The invention is obviously not limited to the particular embodiment as described and illustrated in the attached drawings, but on the contrary covers any alternative design based on the same mechanical features.

What is claimed is:

1. A multi-pole circuit breaker having an insulating housing, a plurality of poles positioned in said housing, an operating mechanism supported in said housing, a plurality of movable contacts operated by said operating mechanism, said operating mechanism comprising:

a toggle joint with a lower link and an upper link connected by a knee pivot pin;

a trip hook pivotally mounted on a fixed pivot, said upper link being operatively connected to said trip hook;

a handle supporting rocker pivotable between closed and open positions to open and close said contacts;

a bar of insulating material, connected mechanically to the lower link of the toggle joint, to drive the movable contacts of the poles between closed and open positions;

a spring having a first end anchored to the rocker and a second end anchored to said knee pivot pin of the toggle joint;

a releasable latch to engage the trip hook in a latched position, said upper link having an extension forming a drive lever with a drive lug cooperating with said rocker, said drive lug rotating to move said trip hook to said latched position when said rocker is moved by the handle towards the open position, said rocker being operable between open and closed positions to operate said spring, when said latch and trip hook are in said latched position, to alternately collapse and allow expansion of said toggle joint to respectively open and close said contacts; and a trip device automatically operable upon the occurrence of overload current conditions above a predetermined value to effect release of said latch whereupon said spring operates to move said movable contacts to the open position.

2. A circuit breaker according to claim 1, wherein said rocker comprises a shoulder cooperating with the drive lug of the drive lever in a welded closed position of the contacts to block the movement of the rocker towards the open position.

3. A circuit breaker according to claim 1, wherein said trip device comprises a swivel mounted releasable catch being movable between releasing, latching and end positions, the latching position being an intermediate balanced position between said releasing and end positions, to engage with said latch in the latching position and to release the latch in the releasing position and a spring biasing said catch towards said intermediate position.

4. A circuit breaker according to claim 3, wherein said catch is provided with a bore having a radial projection and a pin provided with a groove extending through said bore, said radial projection fitting into said groove so as to limit the relative movement between the catch and pin to a swivel movement.

5. A circuit breaker according to claim 1, comprising longitudinal partition walls of the insulating housing defining a plurality of pole compartments wherein the poles of the circuit breaker are positioned, and coaxial bushings supported by said longitudinal walls, said bar of insulating material being pivotally mounted on said coaxial bushings.

* * * * *